US010596680B2

(12) United States Patent
Kim

(10) Patent No.: US 10,596,680 B2
(45) Date of Patent: Mar. 24, 2020

(54) HAND GRINDER AND METHOD OF COUPLING GRINDING DISC OF HAND GRINDER

(71) Applicant: E&Q One-Touch Co., Ltd., Ulsan (KR)

(72) Inventor: Chang Seong Kim, Ulsan (KR)

(73) Assignee: E&Q ONE-TOUGH CO., LTD., Ulsan (KR)

( * ) Notice: Subject to any disclaimer, the term of this patent is extended or adjusted under 35 U.S.C. 154(b) by 130 days.

(21) Appl. No.: 15/826,251

(22) Filed: Nov. 29, 2017

(65) Prior Publication Data

US 2018/0200859 A1 Jul. 19, 2018

Related U.S. Application Data

(63) Continuation of application No. PCT/KR2017/013479, filed on Nov. 24, 2017.

(30) Foreign Application Priority Data

Jan. 16, 2017 (KR) ..... 10-2017-0007250

(51) Int. Cl.
*B24B 23/02* (2006.01)

(52) U.S. Cl.
CPC ..... *B24B 23/028* (2013.01)

(58) Field of Classification Search
CPC .... B24B 23/028; B24B 45/006; B24B 41/007
See application file for complete search history.

(56) References Cited

U.S. PATENT DOCUMENTS 6,523,214 B1 2/2003 Kaiser
2007/0293380 A1* 12/2007 Kausch ..... B24B 45/006 483/31
2017/0259398 A1* 9/2017 Kim ..... B24B 45/00

FOREIGN PATENT DOCUMENTS

JP 2005-523829 A 8/2005
JP 2005-305603 A 11/2005
(Continued)

OTHER PUBLICATIONS

Japanese Office Action, without translation, dated Feb. 19, 2019 for Japanese Patent Application No. 2017-563107; 3 pages.
(Continued)

*Primary Examiner* — Dung Van Nguyen
(74) *Attorney, Agent, or Firm* — Brinks Gilson & Lione

(57) ABSTRACT

The present inventive concept relates to a hand grinder including a grinder main body, a coupler including a power transfer member coupled to a rotary shaft of a grinder main body and a main body provided between the grinder main body and power transfer member, and a grinding disc including a grinding stone having a hollow disc plate and a coupling portion provided at a central portion of the grinding stone and detachably coupled to the coupler. A plurality of hook steps are radially arranged along an outer circumference of an upper end portion of the power transfer member, and a plurality of coupling pieces are radially arranged on an inner circumference of a central portion of the coupling portion. When the grinding disc is assembled such that the hook steps pass between the coupling pieces and the main body is rotated, a lower surface of the hook steps is placed on an upper surface of the coupling pieces and the grinding disc is fixed to the coupler.

20 Claims, 21 Drawing Sheets

(56) References Cited

FOREIGN PATENT DOCUMENTS

| | | | | | |
|---|---|---|---|---|---|
| JP | 2012-218151 | A | | 11/2012 | |
| JP | 2013-515619 | A | | 5/2013 | |
| KR | 1020090074461 | | | 7/2009 | |
| KR | 10-2010-0008489 | | * | 1/2010 | ..... B24B 23/00 |
| KR | 101483963 | B1 | | 1/2015 | |
| WO | WO 2016/085052 | A1 | | 6/2016 | |

OTHER PUBLICATIONS

International Search Report for International Application No. PCT/KR2017/013479 dated Mar. 5, 2018; 15 pages.

* cited by examiner

FORWARD ROTATION:
-BALL PLUNGERS ARE MOVED IN ORDER OF FIRST AND THIRD CIRCULAR RECESSES → SECOND AND FOURTH CIRCULAR RECESSES → THIRD AND FIFTH CIRCULAR RECESSES

REVERSE ROTATION:
-BALL PLUNGERS ARE MOVED IN ORDER OF FIFTH AND THIRD CIRCULAR RECESSES → FOURTH AND SECOND CIRCULAR RECESSES → THIRD AND FIRST CIRCULAR RECESSES

HAND GRINDER AND METHOD OF COUPLING GRINDING DISC OF HAND GRINDER

CROSS-REFERENCE TO RELATED APPLICATIONS

This application is a continuation of PCT/KR2017/013479 filed on Nov. 24, 2017, which claims priority to Korean Patent Application No. 10-2017-0007250, filed on Jan. 16, 2017, the entirety of all of which are hereby incorporated by reference herein.

TECHNICAL FIELD

The present disclosure relates to a hand grinder and a method of coupling a grinding disc of a hand grinder, and more particularly, to a hand grinder and a method of coupling a grinding disc of a hand grinder, in which a consumable grinding disc that is coupled to a rotary shaft of a grinder main body to trim or cut a surface of an object to be machined may be simply and rapidly coupled or decoupled, or may be prevented from being loosened or vibrated.

BACKGROUND

In general, hand grinders used for industrial machinery, shipbuilding, and other equipment are mainly used to smooth rough surfaces of primarily machined parts and portions to be painted, or to partially cut primary raw materials such as pipes, angles, iron plates, etc.

In other words, the hand grinder operates the rotary shaft at high speed by air pressure generated by the operation of an electric motor drive or a compressor, and at the same time, drives a grinding disc mounted on the rotary shaft to grind and polish a surface of an object formed of stone or metallic materials or trim or cut a portion or a corner that is not sufficiently machined, thereby finishing work.

As a structure to couple the grinding disc to the rotary shaft of a hand grinder, Korean Utility Model Publication Nos. 89-10365 and 96-26826 disclose that a grinding disc is inserted in a rotary shaft mounted in a grounder main body and fixed thereto by using a nut or by coupling a bolt to the rotary shaft.

Accordingly, in the structure, since a grinding disc is simply coupled to the grinder main body by using a bolt or nut, a coupling force therebetween is lowered due to a frictional force or fine vibration of the grinding disc rotating at high speed, making an operator feel uncomfortable, and actually the grinding disc is loosened during work, causing a safety accident. To prevent such an accident, a fixed-type cover is separately installed around the grinding disc.

Furthermore, when the grinding disc is replaced due to a long time use of a hand grinder, a bolt or nut portion may be hardened as foreign materials such as ground particles adhere thereto. Thus, the coupling of a bolt or nut is difficult so that the coupling is not secure, and thus a safety accident may occur.

Considering the above-described problems, Korean Patent Publication No. 2009-0074461 discloses a technology to provide a fixing holder on a rotary shaft of a grinder main body to couple a disc-integrated disc holder by screw coupling, thereby preventing a disc from being loosened from the fixing holder. Also, the technology enables the disc to be easily and rapidly coupled to or decoupled from the fixing holder through a break unit mounted on the grinder main body.

In the above structure, since the disc holder needs to be coupled to the fixing holder on the rotary shaft by screw coupling, it is inconvenient to release or recombine the disc holder during work. Also, since the separate break unit needs to be operated, it is quite inconvenient to an operator.

Furthermore, as another solution to address the problems, Korean Patent No. 0973157 discloses a technology which enables a disc holder mounted on a rotary shaft of a grinder main body to be simply coupled in a one-touch method so that the coupling/decoupling of the disc holder may be made easier and simultaneously the loosing of the disc holder may be prevented in advance by the operation of a safety key mounted in a stopper.

In the above-described structure, however, since foreign materials such as ground particles may adhere in a housing and the stopper, the operation of the safety key may be defective and also vibration may be generated during a grinding work.

Furthermore, the above structure needs lots of parts related to each other, and thus manufacturing costs are increased. Thus, the structure gives a considerable financial burden to work sites using a lot of consumables, for example, large shipyards.

TECHNICAL PROBLEM

It is an object of the present disclosure to provide a hand grinder and a method of coupling a grinding disc of a hand grinder, which may enable simple and rapid coupling/decoupling of a grinding disc, and may prevent loosening and vibrating.

TECHNICAL SOLUTION

In accordance with one aspect of the present disclosure, a hand grinder include a grinder main body, a coupler including a power transfer member coupled to a rotary shaft of a grinder main body and a main body provided between the grinder main body and power transfer member, and a grinding disc including a grinding stone having a hollow disc plate and a coupling portion provided at a central portion of the grinding stone and detachably coupled to the coupler, in which a plurality of hook steps are radially arranged along an outer circumference of an upper end portion of the power transfer member, and a plurality of coupling pieces are radially arranged on an inner circumference of a central portion of the coupling portion, and when the grinding disc is assembled such that the hook steps pass between the coupling pieces and the main body is rotated, a lower surface of the hook steps is placed on an upper surface of the coupling pieces and the grinding disc is fixed to the coupler.

In accordance with another aspect of the present disclosure, a method of coupling a grinding disc of a hand grinder includes preparing a grinding disc including a grinding stone having a hollow disc shape and a coupling portion having a hollow disc shape coupled to a central portion of the grinding stone, wherein a plurality of coupling pieces protrude inwardly toward the coupling portion (first operation); preparing a coupler inserted into a hollow hole of the coupling portion and coupled thereto, having a power transfer member that is a center axis, formed at a central portion thereof, and having hook steps having a shape capable of passing between a pair of neighboring coupling pieces, formed at an end portion of the power transfer member (second operation); placing the grinding disc on the coupler such that the hook steps pass between the coupling pieces (third operation); and coupling the grinding disc to the coupler by rotating the grinding disc such that a rear surface of each of the hook steps contacts an upper surface of each of the coupling pieces (fourth operation).

ADVANTAGEOUS EFFECTS

According to the present disclosure, the grinding disc may be simply and rapidly coupled/decoupled, and may be prevented from being loosened and vibrated.

DETAILED DESCRIPTION

Figure 1:
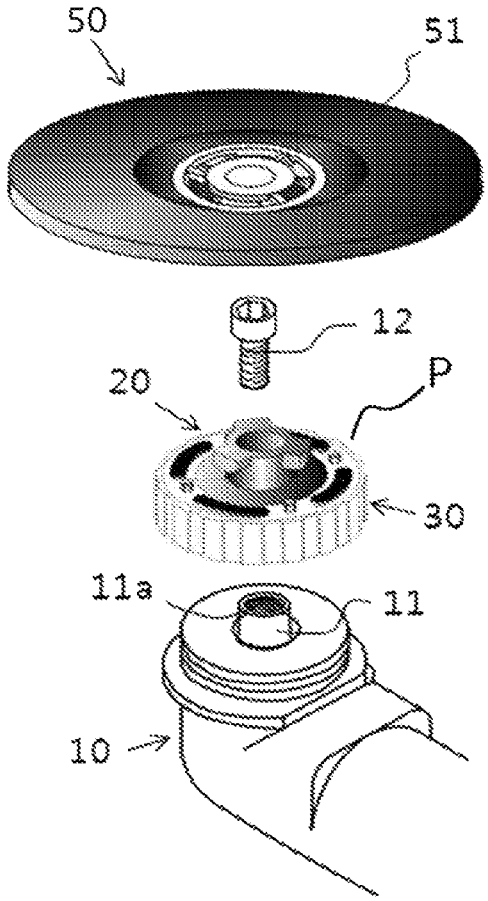
FIG. 1 is an exploded perspective view showing that a coupler and a grinding disc are decoupled from a hand grinder of the present disclosure.
Figure 2:
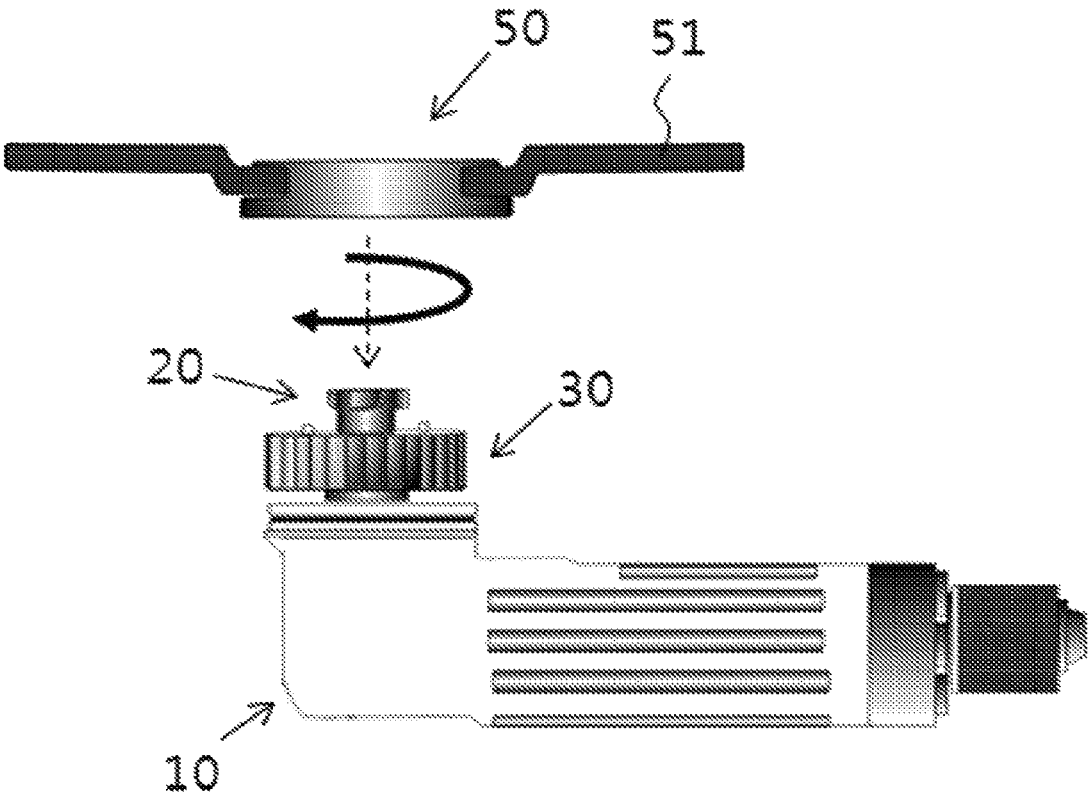
FIG. 2 is a side view showing that the grinding disc from the coupler mounted on the hand grinder according to the present disclosure.
Figure 3:
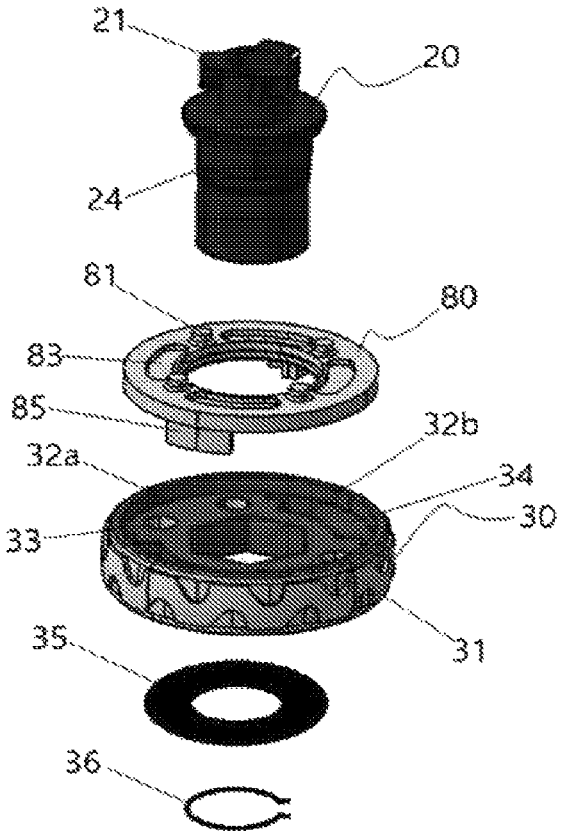
FIG. 3 is an explode perspective view of the coupler according to the present disclosure.
Figure 4:
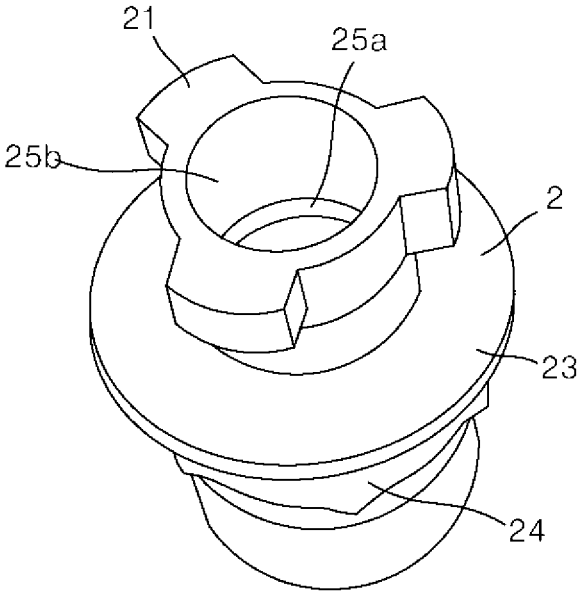
FIG. 4 is a perspective-view image of a power transfer member of the coupler according to the present disclosure.
Figure 5:
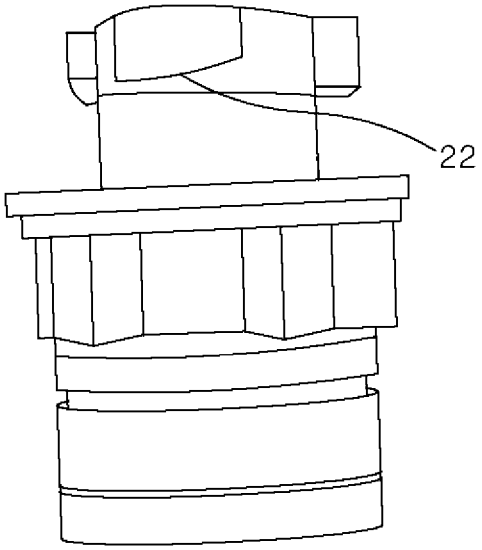
FIG. 5 is a side-view image of FIG. 4.
Figure 6:
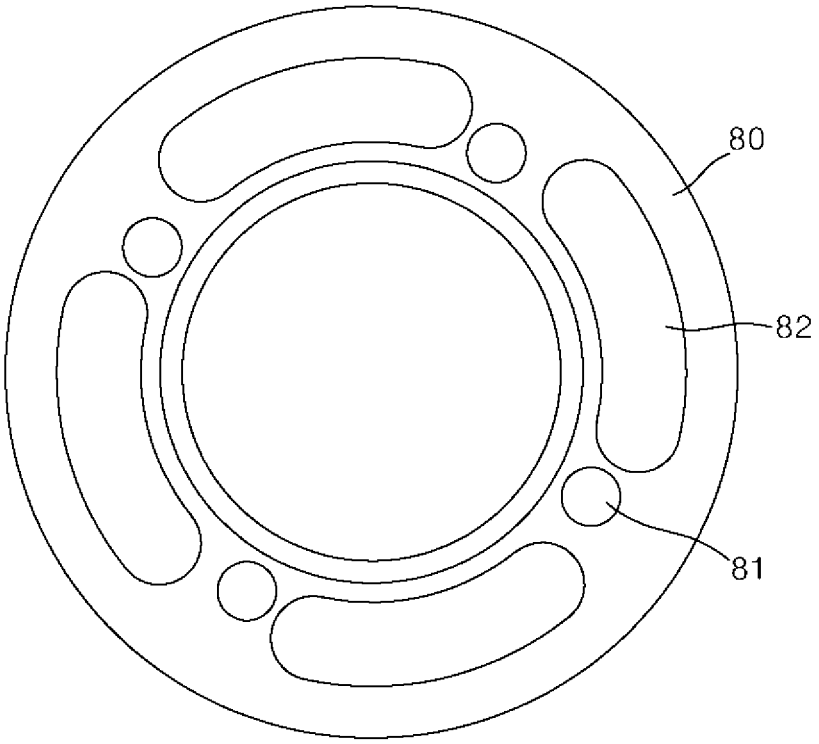
FIG. 6 is a plan-view image of a rotary plate of the coupler according to the present disclosure.
Figure 7:
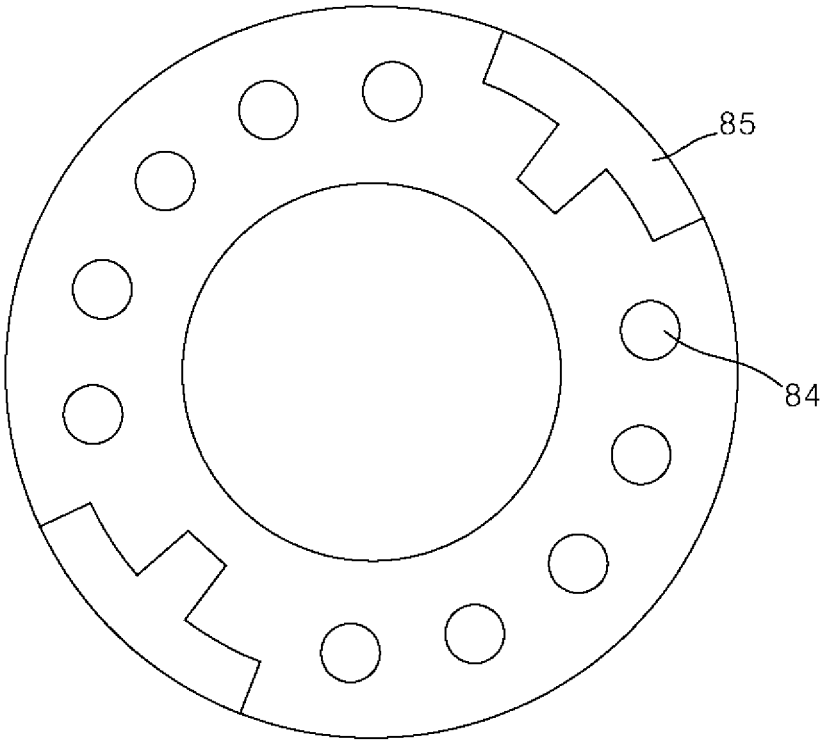
FIG. 7 is a rear-view image of the rotary plate of the coupler according to the present disclosure.
Figure 8:
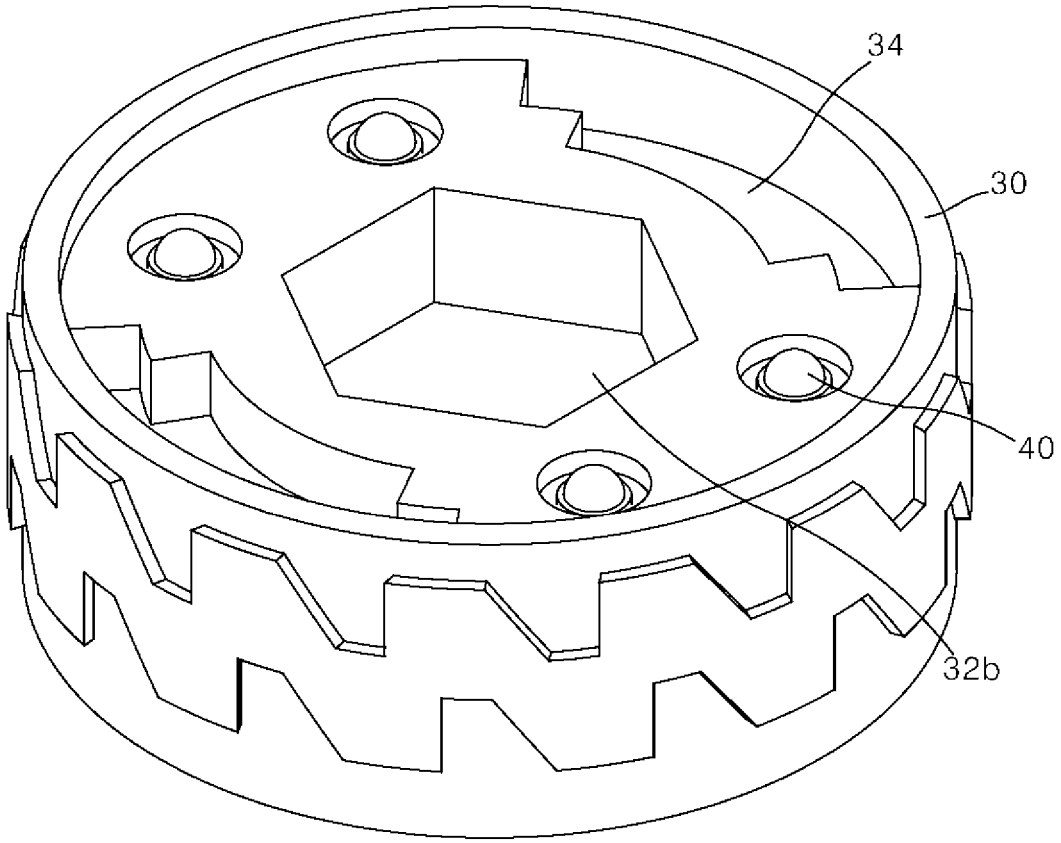
FIG. 8 is a plan-view image of a main body of the coupler according to the present disclosure.
Figure 9:
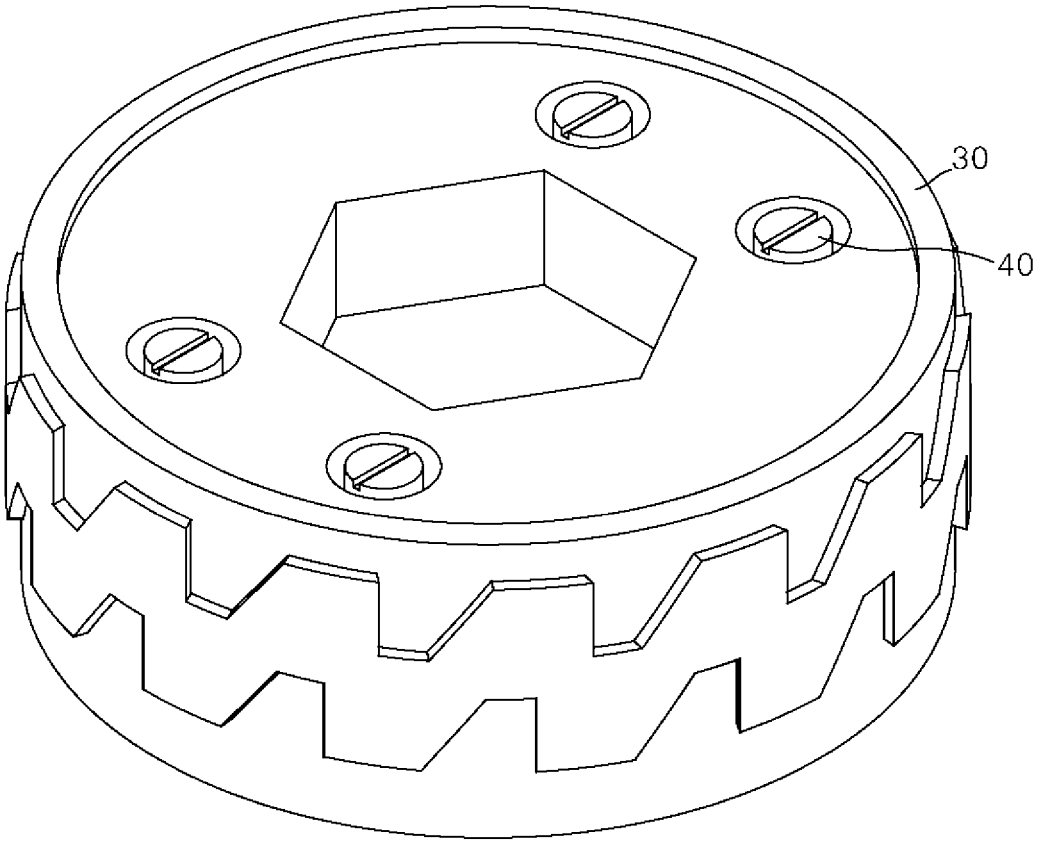
FIG. 9 is a bottom-view image of the main body of the coupler according to the present disclosure.
Figure 10:
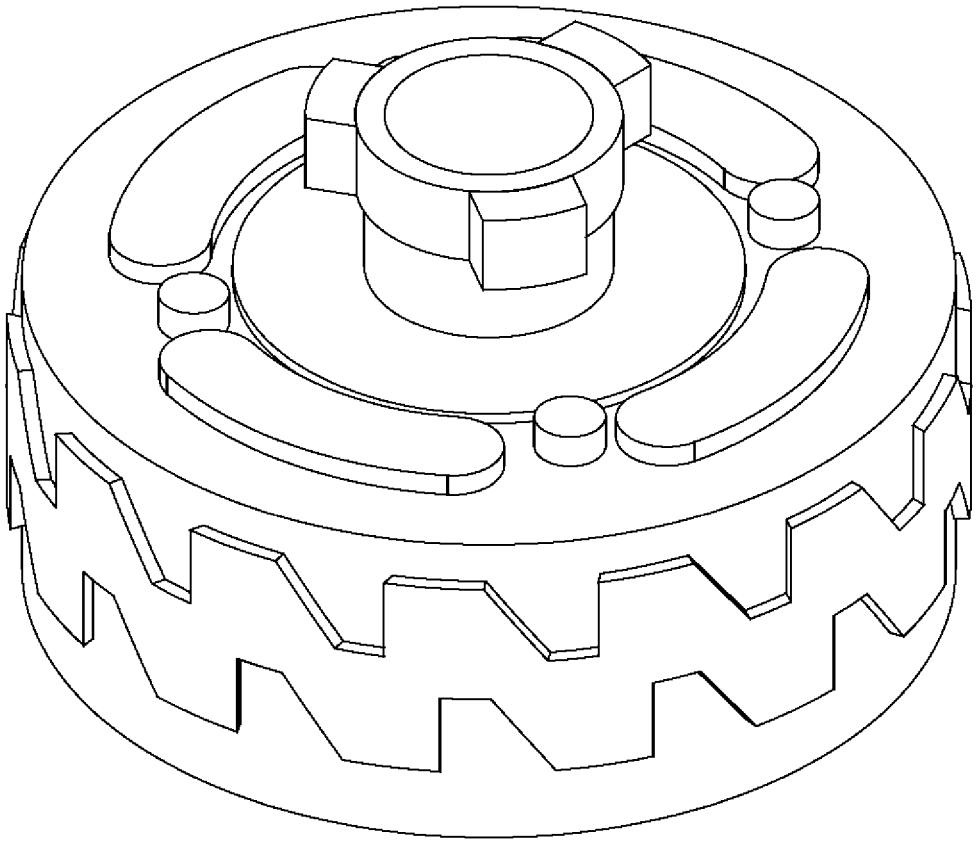
FIG. 10 is a perspective-view image of the coupler according to the present disclosure.
Figure 11:
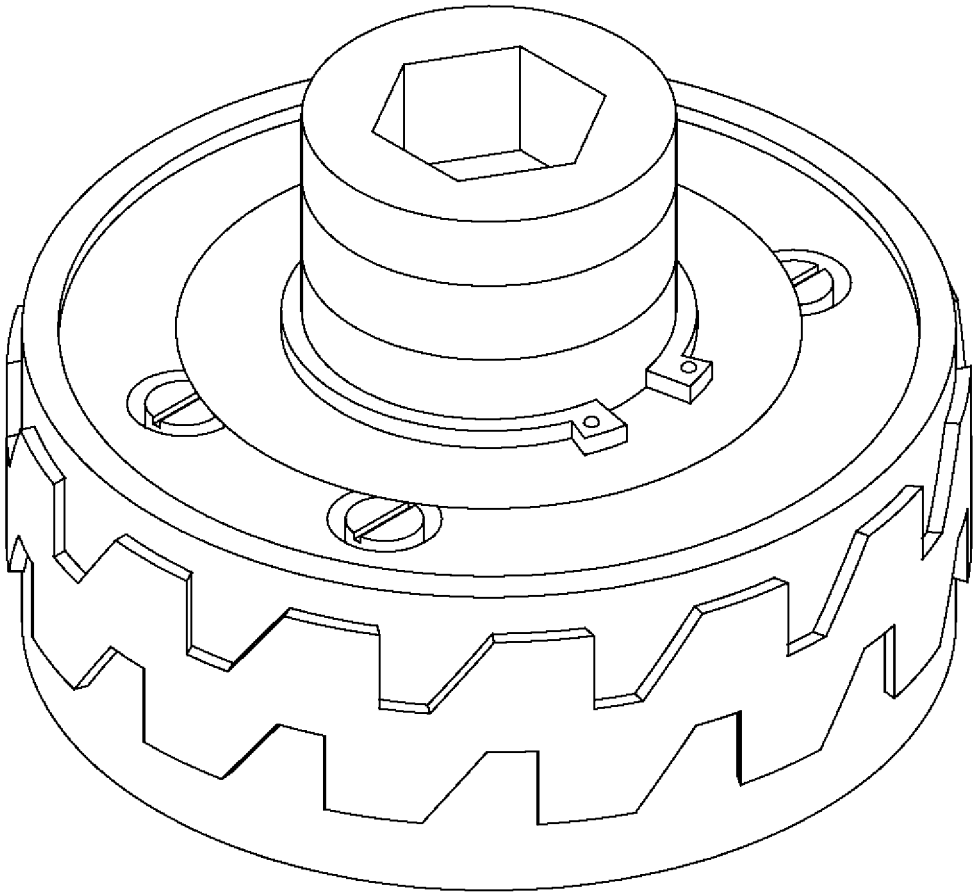
FIG. 11 is a rear-perspective-view image of the coupler according to the present disclosure.
Figure 12:
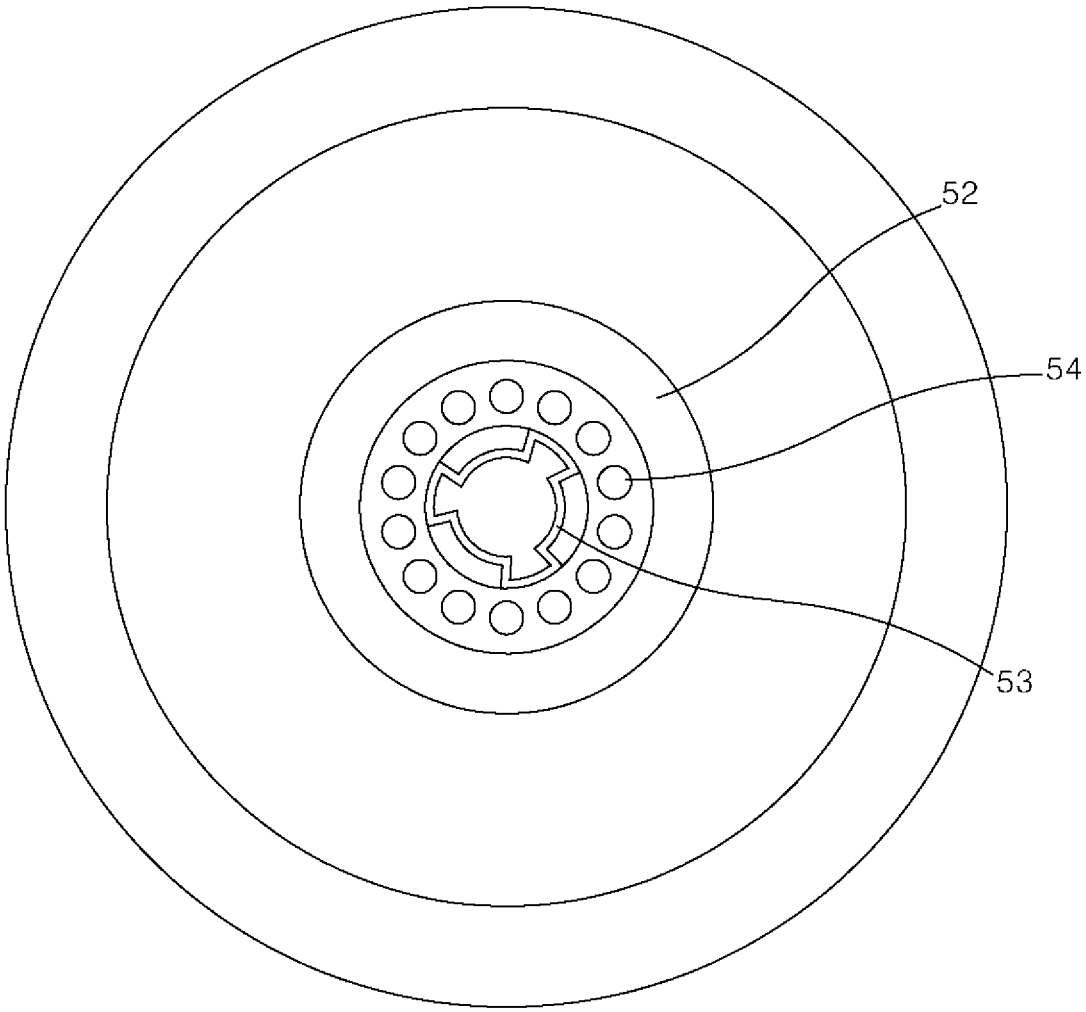
FIG. 12 is a rear-view image of a grinding disc according to the present disclosure.
Figure 13:
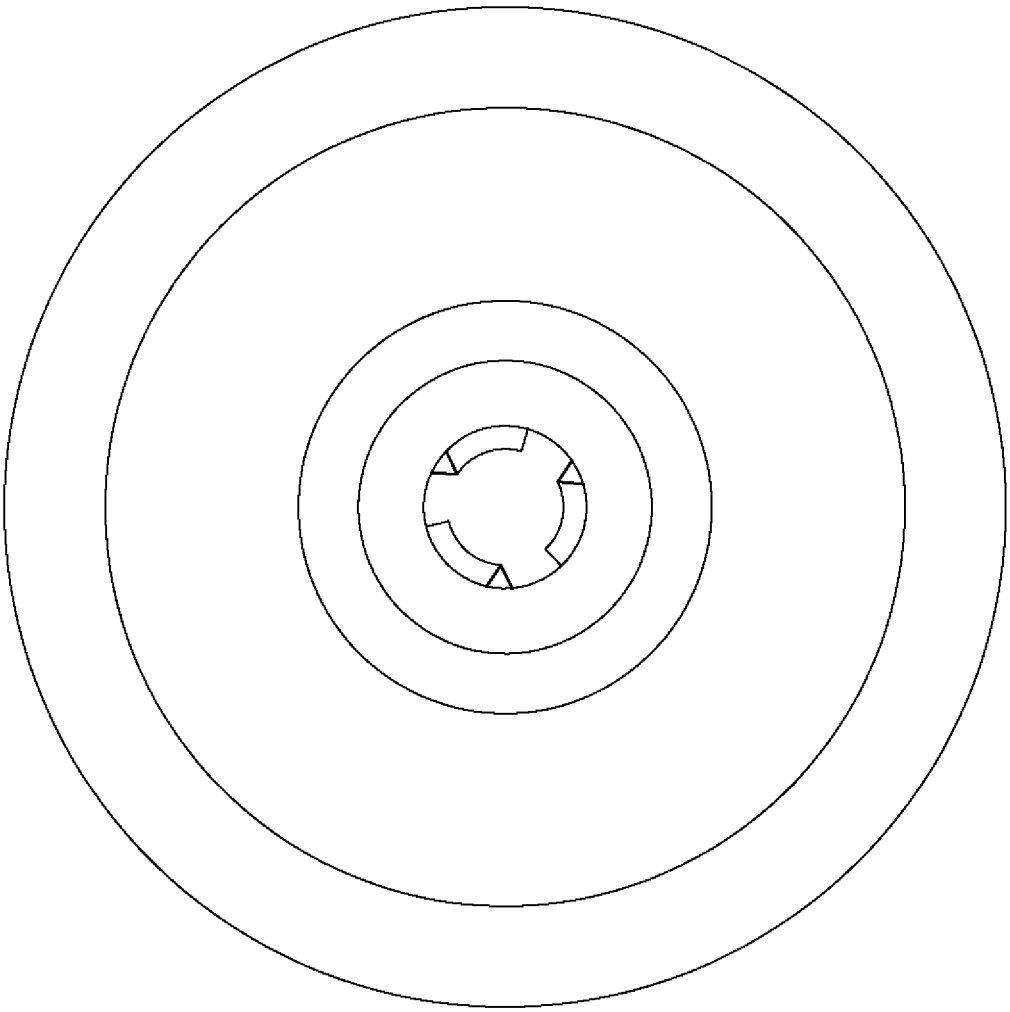
FIG. 13 is a plan-view image of the grinding disc according to the present disclosure.
Figure 14:
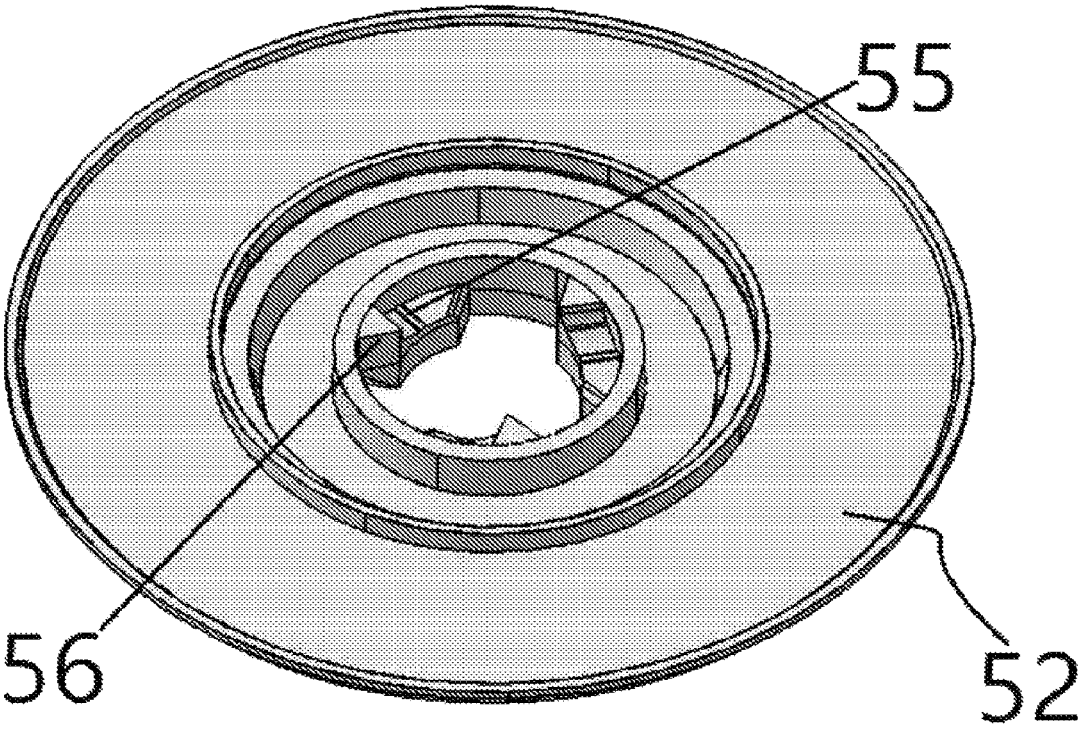
FIG. 14 is a plan-perspective view image of a coupling portion of the grinding disc according to the present disclosure.
Figure 15:
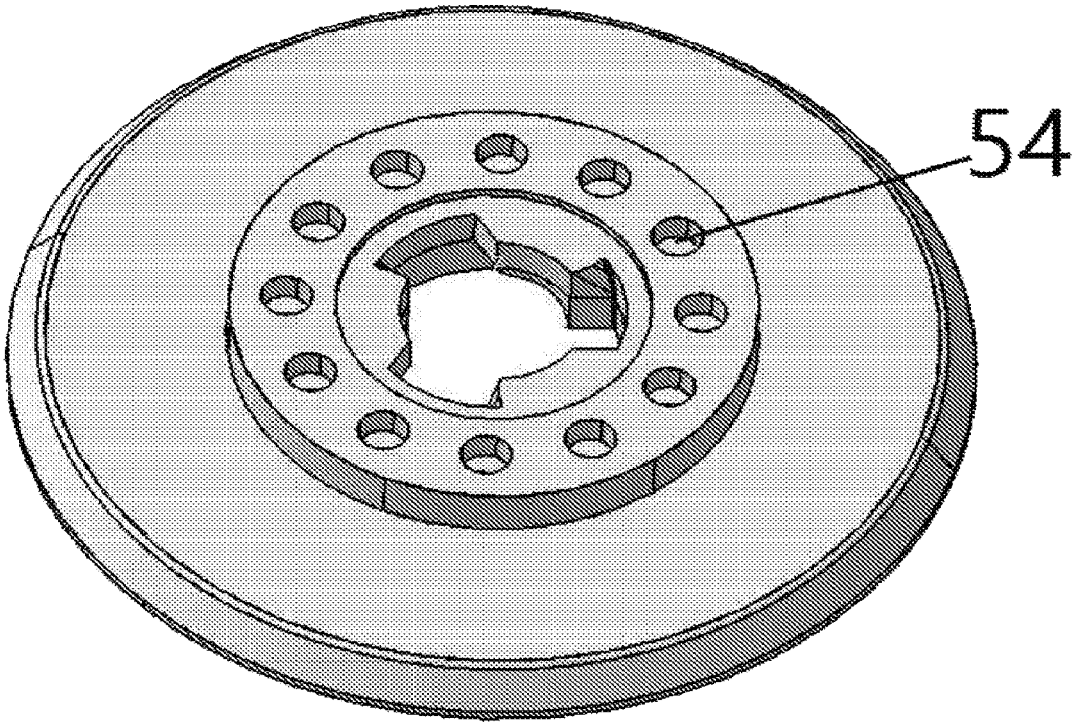
FIG. 15 is a rear-perspective view image of the coupling portion of the grinding disc according to the present disclosure.

The present inventive concept will now be described more fully with reference to the accompanying drawings, in which embodiments of the inventive concept are shown. In the following description, when detailed descriptions about related well-known functions or structures are determined to make the gist of the present inventive concept unclear, the detailed descriptions will be omitted herein. Throughout the drawings, like reference numerals denote like elements.

As illustrated in the accompanying drawings, the present disclosure includes a typical grinder main body 10, a power transfer member 20 and a main body 30 for constituting a coupler P, and a grinding disc 50 having a holder for coupling/decoupling the grinding disc 50 with respect to the coupler P.

Furthermore, the present disclosure may further include a protruding surface 31 formed on an outer circumferential surface of the main body 30 and a variable safety cover 70 mounted on the grinder main body 10 for safety of an operator.

A rotary shaft 11 having a screw hole 11*a* is provided on one side end of the grinder main body 10 is provided to drive at high speed by air pressure according to the operation of an electric motor or a compressor. The power transfer member 20 is mounted on the rotary shaft 11 by a fixing bolt 12.

The power transfer member 20 that serves as a center axis for constituting the coupler P includes three hook steps 21 formed on an outer circumference of an upper end portion thereof at an interval of 120° and simultaneously a recess 22 is formed on a lower surface portion of each of the hook steps 21. A hexagonal main body 24 including a flange 23 is formed at a central portion of the power transfer member 20. Furthermore, the hook steps 21 may be three or more.

Furthermore, a through-hole 25*b* having a step 25*a* is formed inside the hexagonal main body 24, into which the fixing bolt 12 may be inserted to be coupled thereto.

The protruding surface 31 is formed on the outer circumferential surface of the main body 30, a hexagonal hole 32*b* having a step 32*a* is formed at the center inside the main body 30, and simultaneously two pairs of coupling holes 33 and a pair of receiving recesses 34 are formed in a flat plate portion outside the hexagonal hole 32*b*, and a rotary plate 80 is coupled to an upper surface of the flat plate portion of the main body 30.

The two pairs of coupling holes 33 are symmetrically formed with respect to the hexagonal hole 32*b*, and the receiving recesses 34 are symmetrically formed with respect to the hexagonal hole 32*b*.

A ball plunger 40 is placed in each of the coupling holes 33 of the main body 30, and the ball plunger 40 slightly protrudes upward from the flat plate portion.

The power transfer member 20 is inserted, top to bottom, into the hexagonal hole 32*b* of the main body 30. As a washer 35 is inserted on a lower end portion of the power transfer member 20, a snap ring 36 is mounted in a slot formed in an outer circumferential surface of the power transfer member 20, and thus the main body 30 and the power transfer member 20 may be fixedly assembled to each other.

Furthermore, the rotary plate 80 is rotatably coupled to an upper surface portion of the main body 30. A plurality of circular protrusions 81 are formed on an upper surface of the rotary plate 80. A pad receiving recess 83 in which an antivibration pad 82 is placed is formed. A plurality of circular recesses 84 are formed in a lower surface of the rotary plate 80 corresponding to the ball plunger 40 protruding upward from the flat plate portion of the main body 30. A pair of guide protrusions 85 inserted into the receiving recesses 34 formed in the flat plate portion of the main body 30 are formed on the lower surface of the rotary plate 80.

The guide protrusions 85 that are respectively inserted into the receiving recesses 34 prevent the rotary plate 80 that rotates by being coupled to the upper surface of the main body 30 from rotating a certain distance or more.

The circular recesses 84 are formed in fives each at left and right sides with respect to the guide protrusions 85. The ball plunger 40 is inserted in each of two consecutive odd-numbered circular recesses of the five circular recesses 84.

In this state, the five circular recesses 84 formed in the lower surface of the rotary plate 80 are classified into the first, second, third, fourth, and fifth circular recesses. Before the coupler P and the grinding disc 50 are coupled to each other, the ball plungers 40 are respectively inserted in the first and third circular recesses of the five circular recesses 84 formed in the lower surface of the rotary plate 80. When the coupler P and the grinding disc 50 are coupled to each other, the ball plungers 40 are respectively inserted in the third and fifth circular recesses of the five circular recesses 84 formed in the lower surface of the rotary plate 80.

When a user rotates the grinding disc 50 in a forward direction to couple the coupler P and the grinding disc 50 to each other, the rotary plate 80 rotates with the grinding disc 50 in the same direction, the ball plungers 40 that are respectively inserted in the first and third circular recesses of the five circular recesses 84 formed in the lower surface of the rotary plate 80 are located at the third and fifth circular recesses via the second and fourth circular recesses.

Accordingly, the coupler P and the grinding disc 50 coupled to the grinder main body 10 may be firmly coupled to each other, and may absorb impact transferred to the grinding disc 50.

While the coupler P and the grinding disc 50 that are coupled to the grinder main body 10 rotate, when the rotary shaft 11 of the grinder main body 10 suddenly stops, the main body 30 of the coupler P that is directly coupled to the rotary shaft 11 of the grinder main body 10 is stopped with the rotary shaft 11.

The grinding disc 50 is directly coupled to the rotary plate 80 of the coupler P. When the rotation of the coupler P is stopped, the grinding disc 50 rotating with the coupler P in the same direction is stopped as well. The grinding disc 50 continues to rotate in a previous rotation direction by inertia force, and inertia force is generated in the rotary plate 80 coupled to the grinding disc 50 to continue to rotate in the previous rotation direction.

While the rotary plate 80 receives the inertia force to rotate in the previous rotation direction, the ball plunger 40 prevents the rotary plate 80 from rotating, and thus the grinding disc 50 stops rotating. Accordingly, a reverse load in a direction opposite to the previous rotation direction, that is, to stop the rotation due to inertia, is applied to the rotary plate 80.

In detail, although the rotary plate 80 receives a force in the opposite direction to the previous rotation direction by the reverse load, since the ball plungers 40 are respectively inserted in the third and fifth circular recesses 84 of the rotary plate 80, neither the rotary plate 80 nor the grinding disc 50 rotate any longer.

When an excessive reverse load is applied to the rotary plate 80, even when the ball plungers 40 are respectively inserted in the third and fifth circular recesses 84 of the rotary plate 80, the rotary plate 80 is rotated in the same direction as the previous rotation direction due to inertia, and thus the second and fourth circular recesses 84 of the rotary plate 80 are located at the ball plungers 40 that stand still, the ball plungers 40 inserted in the third and fifth circular recesses 84 of the rotary plate 80 and stand still are inserted into the second and fourth circular recesses 84 of the rotary plate 80 because the rotary plate 80 is rotated in the same direction as the previous rotation direction.

Accordingly, the reverse load applied to the rotary plate 80 decreases, and thus the rotary plate 80 coupled to the main body 30 does not rotate and the grinding disc 50 coupled to the rotary plate 80 does not rotate either.

Therefore, in the coupler P and the grinding disc 50 coupled to the grinder main body 10 by the coupling of the above elements, the coupling of the elements may be easy, the impact applied to the grinding disc 50 may be absorbed, and the grinding disc 50 coupled to the coupler P may be prevented from being decoupled due to the reverse load, thereby improving safety.

In another embodiment of the present disclosure, among the five circular recesses 84 formed in the lower surface of the rotary plate 80, the depth of the second and fourth circular recesses is deeper than the depth of the first, third, and fifth circular recesses.

Accordingly, when an excessive reverse load is applied to the grinding disc 50, the rotary plate 80 and the grinding disc 50 receive a force in a direction opposite to the previous rotation direction, the ball plungers 40 located at the third and fifth circular recesses 84 of the rotary plate 80 are located at the second and fourth circular recesses 84 of the rotary plate 80. The ball plungers 40 located at the second and fourth circular recesses 84 of the rotary plate 80 are inserted deeper than when inserted in the first, third, and fifth circular recesses 84 of the rotary plate 80, and thus a greater force is needed to separate the ball plungers 40 from the second and fourth circular recesses 84 of the rotary plate 80.

Thus, the grinding disc 50 may be prevented from being separated from the coupler P.

In an example, when the depth of the first, third, and fifth circular recesses 84 of the rotary plate 80 is about 0.9 mm to about 1.4 mm, the depth of the second and fourth circular recesses 84 of the rotary plate 80 is about 1.5 mm to about 2.0 mm.

In an example, when the depth of the first, third, and fifth circular recesses 84 of the rotary plate 80 is about 1.3 mm, an optimal depth of the second and fourth circular recesses 84 of the rotary plate 80 is about 1.5 mm.

Furthermore, in the lower surface of the rotary plate 80, a protruding step is formed downward between the second circular recess and the third circular recess, and another protruding step is formed downward between the fourth circular recess and the fifth circular recess.

In this state, the protruding step formed between the second circular recess and the third circular recess of the rotary plate 80 is formed at a position close to the second circular recess, that is, a position corresponding to ⅓ of the entire distance between the second circular recess and the third circular recess, and has a vertical section having a right triangle in which a vertical plane is formed at the side of the second circular recess and an inclined surface is formed to be upwardly inclined from the vertical plane toward the third circular recess. An inclination angle of the protruding step is about 5° to about 20°.

In an example, an optimal inclination angle of the protruding step is 10°.

Furthermore, the protruding step formed between the fourth circular recess and the fifth circular recess has the same shape and size as the protruding step formed between the second circular recess and the third circular recess.

Accordingly, when an excessive reverse load is applied to the grinding disc 50, the grinding disc 50 and the rotary plate 80 receive a force in the opposite direction to the previous rotation direction, and the ball plungers 40 are moved from the third and fifth circular recesses 84 of the rotary plate 80 to the second and fourth circular recesses 84 of the rotary plate 80. As the ball plungers 40 contact the steps formed on the lower surface of the rotary plate 80, the reverse load to the grinding disc 50 receiving the force in the reverse direction may be reduced much.

Furthermore, by forming an uneven portion on the lower surface of the rotary plate 80, when a reverse load is applied to the grinding disc 50, the grinding disc 50 and the rotary plate 80 receive a force in a direction opposite to the original rotation direction. The ball plungers 40 are moved from the third and fifth circular recesses 84 of the rotary plate 80 to the second and fourth circular recesses 84. As the ball plungers 40 contact the uneven portion on the lower surface of the rotary plate 80, the reverse load to the rotary plate 80 and the grinding disc 50 receiving the force in the reverse direction may be much reduced.

Thus, the grinding disc 50 may be prevented from being separated from the coupler P.

In the grinding disc 50, a grinding stone 51 at the outside and a coupling portion 52 in the grinding stone 51 are coaxially coupled to each other. The grinding stone 51 and the coupling portion 52 are integrally formed by an insert injection method.

Emery (emery, corundum, garnet, etc.) or ordinary ones with glass powder may be used as the grinding stone 51, and the grinding stone 51 is capable of grinding or cutting according to the type of an object and also is a consumable that is disposed of after used at a work site.

Furthermore, insert injection is performed by placing the grinding stone 51 in a lower mold having a shape of the grinding disc 50 and closing an upper mold thereon, and manufacturing the grinding disc 50 by injecting synthetic resin into the mold.

An injection temperature is about 180° C. to about 300° C., and a removal time after injection is about 30 seconds to about 2 minutes and 30 seconds.

Furthermore, the grinding disc 50 that is removed is air-cooled at the room temperature for 24 hours or more.

Furthermore, as three coupling pieces 53 are formed in the coupling portion 52, the coupling pieces 53 of the coupling portion 52 are coupled/decoupled with respect to the hook steps 21 of the power transfer member 20. A plurality of insertion recesses 54 are formed in a lower surface portion of the coupling portion 52. Accordingly, during the coupling/decoupling of the grinding disc 50, the insertion recesses 54 may be coupled to or decoupled from the circular protrusions 81 of the rotary plate 80 assembled to the main body 30.

Since a protrusion 55 is formed on each of the coupling pieces 53 of the coupling portion 52, in a process of mounting the holder of the grinding disc 50, the protrusion 55 is inserted into the recess 22 formed in a lower end portion of the hook steps 21 constituting the power transfer member 20, and thus a fixed state of the grinding disc 50 may be surely maintained.

Furthermore, a stopper 56 is formed to protrude from a surface of the coupling pieces 53 in a thickness direction of the coupling portion 52. The stopper 56 may prevent idling of the power transfer member 20 that serves as the center axis of the coupler P and inserted in the coupling portion 52, and may transfer rotation power of the coupler P to the grinding disc 50 during the rotation of the coupler P.

Furthermore, the coupling pieces 53 are rounded at a coupling start point thereof to facilitate the coupling with the hook steps 21, and the coupling pieces 53 are rounded at a coupling end point thereof to have the hook steps 21 closely contact with the stopper 56. A plane may be formed between the pair of rounded portions. In this case, a coupling force between the grinding disc 50 and the coupler P may be improved.

Furthermore, the protruding surface 31 is formed of a material having elasticity on the outer circumferential surface of the main body 30. Accordingly, during the coupling/decoupling of the grinding disc 50, when a user grips the main body 30 with a hand, slipping may be prevented.

Figure 16:
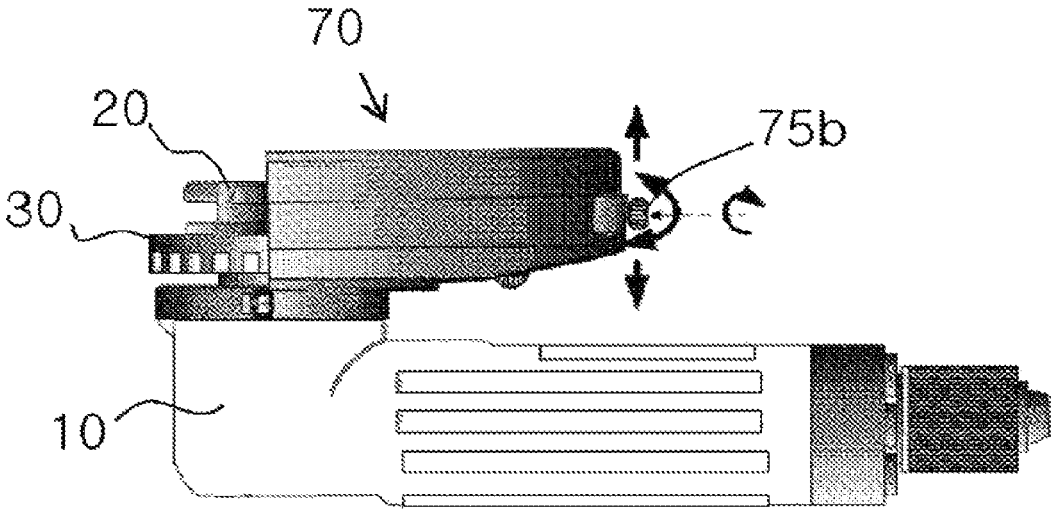
FIGS. 16 and 17 are, respectively, a front view and a plan view of an example in which a safety cover is provided on a grinder main body according to the present disclosure.
Figure 17:
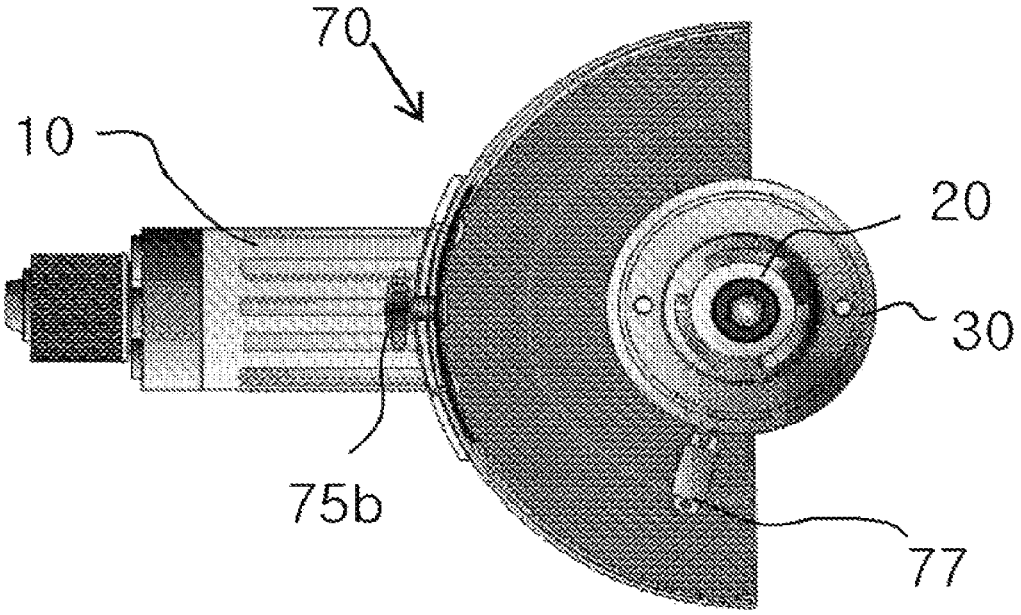
Figure 18:
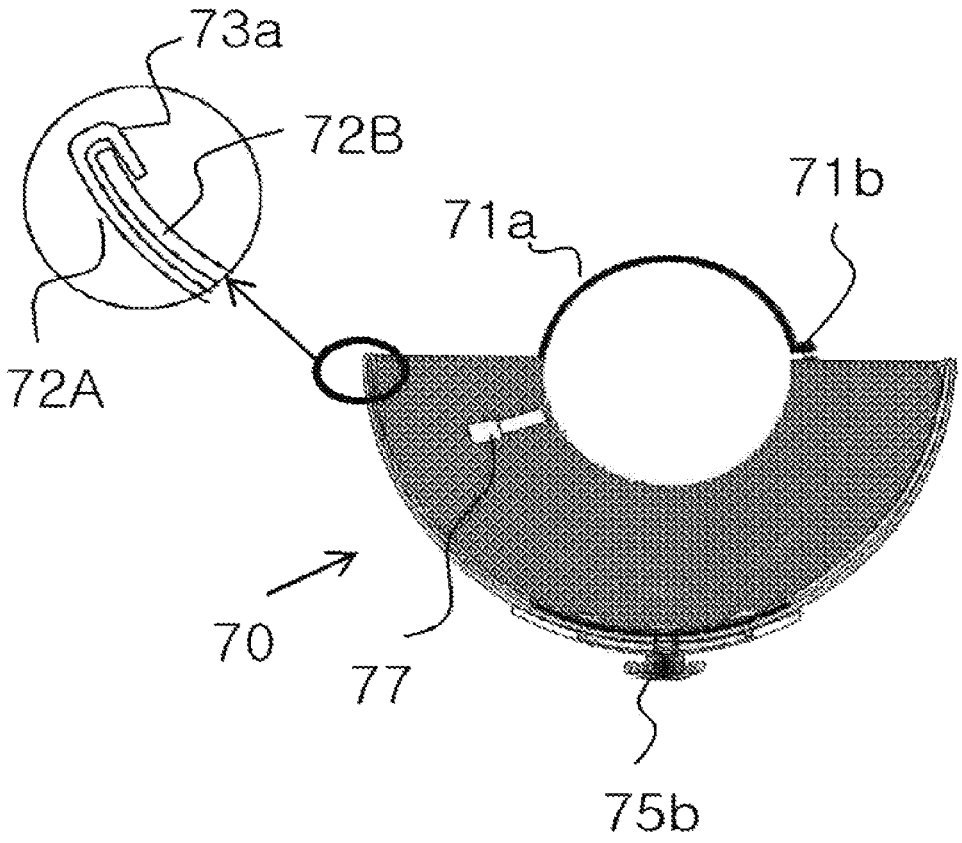
FIG. 18 is a plan view illustrating the safety cover by enlarging a portion thereof.
Figure 19:
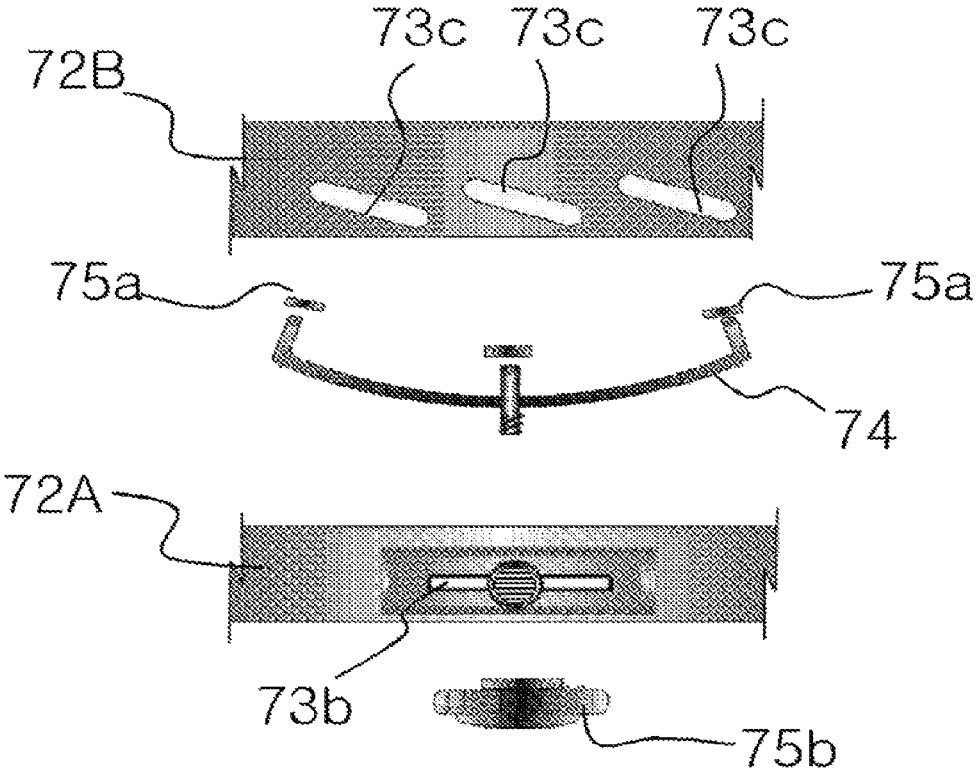
FIG. 19 is a front view of a connection portion of inner/outer semicircular plates forming the safety cover.
Figure 20:
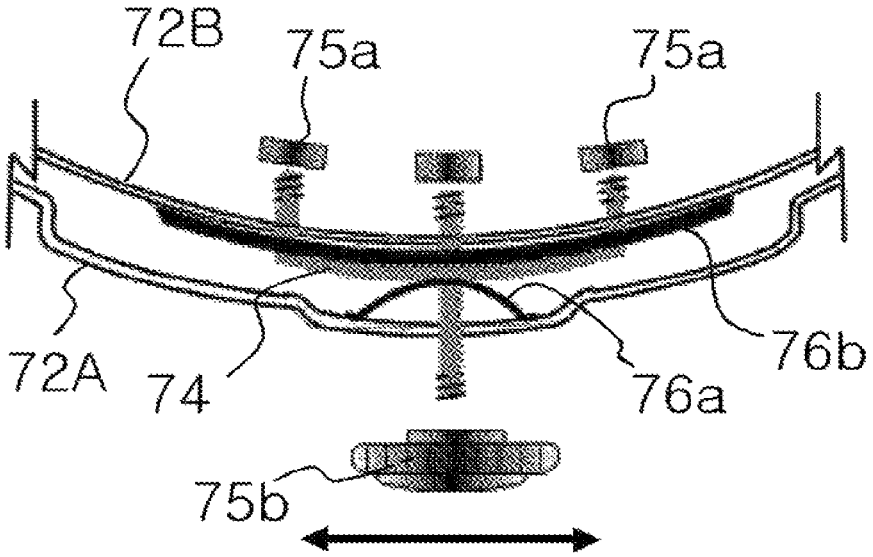
FIG. 20 is a plan view schematically illustrating constituent parts of the safety cover.
Figure 21:
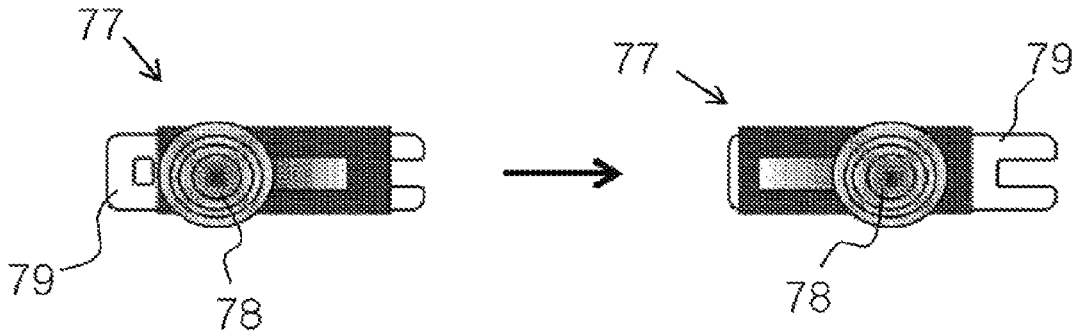
FIG. 21 illustrates an operation state of a stopper key.
Figure 22:
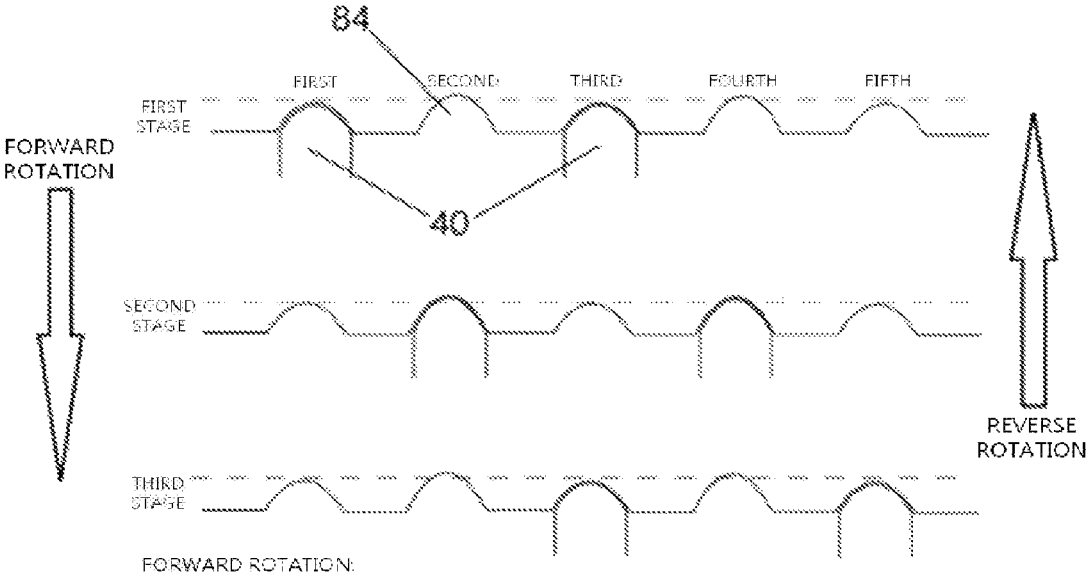
FIG. 22 illustrates an operation state of a ball plunger inserted in a circular recess of a rotary plate according to the present disclosure.
Figure 23:
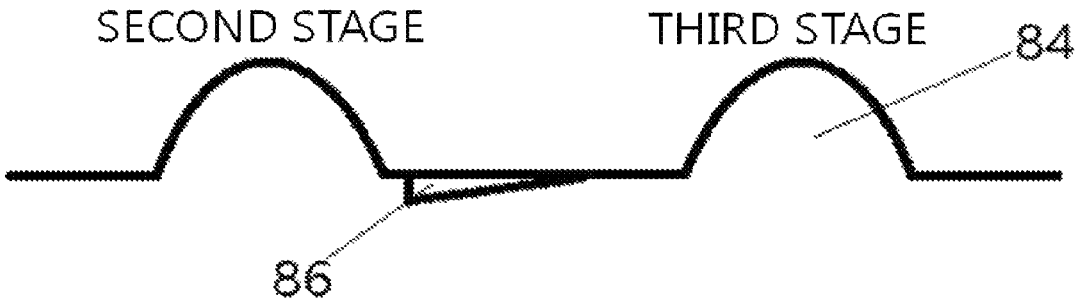
FIG. 23 is a schematic view illustrating that a protruding step is formed on a lower surface of the rotary plate according to the present disclosure.

FIGS. 16 to 21 illustrate a variable safety cover 70 mounted on the grinder main body 10. The variable safety cover 70 is coupled to the rotary shaft 11 of the grinder main body 10 by using a fixing ring 71*a* and a bolt 71*b*.

The variable safety cover 70 includes an outer semicircular plate 72A and an inner semicircular plate 72B, and may be provided to be vertically movable while the inner semicircular plate 72B is inserted into a bent piece 73*a* formed at both end portions of the outer semicircular plate 72A.

A single horizontal slot 73*b* is formed in the outer semicircular plate 72A and simultaneously three inclined slots 73*c* are formed in the inner semicircular plate 72B. As a connection rod 74 is inserted through the horizontal slot 73*b* and the inclined slots 73*c*, the outer semicircular plate 72A and the inner semicircular plate 72B are fastened by a nut 75*a* and a lever 75*b*.

Furthermore, a leaf spring 76*a* and a rubber plate 76*b* are interposed between the outer semicircular plate 72A and the inner semicircular plate 72B, to provide elasticity during manipulation of the lever 75*b*.

Furthermore, a stopper key 77 that is inserted into a recess 31*a* of the main body 30 to be fixed thereto or released therefrom is provided on a bottom plate of the outer semicircular plate 72A. The stopper key 77 is formed of a flat plate member 79 that is operated by a horizontal operation of a lever 78.

In the present disclosure configured as above, first, the coupler P constituted by assembling the power transfer member 20 and the main body 30 is mounted on the rotary shaft 11 of the grinder main body 10, and the fixing bolt 12 is inserted and simultaneously screwed by a wrench (not shown), thereby fixing the coupler P to the rotary shaft 11.

Furthermore, to fix the grinding disc 50 on the power transfer member 20 on the main body 30, while the main body 30 is held by one hand, the holder of the grinding disc 50 is placed on the power transfer member 20 and simultaneously rotated clockwise. Accordingly, the three coupling pieces 53 in the coupling portion 52 constituting the holder are inserted between the three hook steps 21 formed on the power transfer member 20.

Also, as the circular protrusions 81 formed on the main body 30 are inserted into the insertion recesses 54 formed in the lower portion of the coupling portion 52 and the protrusion 55 formed on the coupling pieces 53 of coupling portion 52 is inserted into the recess 22 formed in the hook steps 21 of the power transfer member 20, both the upper and lower sides of the holder of the grinding disc 50 may maintain a coupled state.

Furthermore, since the antivibration pad is mounted on the upper surface of the rotary plate 80 coupled to a flat portion of the main body 30, during the mounting of the grinding disc 50, elasticity works so that assemblability by an operator may be improved and generation of vibration during high-speed work may be prevented.

Accordingly, even when the rotary shaft 11 of the grinder main body 10 is driven at high speed, the grinding disc 50 that is not separated from the coupler P may grind a surface of an object with safe.

Furthermore, when the grinding disc 50 needs to be replaced due to a long use thereof, by holding the main body 30 with one hand and rotating the grinding disc 50 counterclockwise in the opposite direction to the above-described direction, the coupling pieces 53 of coupling portion 52 constituting the holder of the grinding disc 50 are released from the recess 22 including the hook steps 21 of the power transfer member 20 and the circular protrusions 81 on the main body 30, and thus the grinding disc 50 may be easily separated.

In addition, when the protruding surface 31 of an elastic material is formed on the outer circumferential surface of the main body 30 constituting the coupler P, as described above, the coupling/decoupling of the grinding disc 50 is possible and a sense of grip by a worker is improved so that efficient coupling/decoupling of the grinding disc 50 is possible.

For the variable safety cover 70 mounted on the grinder main body 10, the variable safety cover 70 is mounted around the rotary shaft 11 of the grinder main body 10 by using the fixing ring 71*a* and the bolt 71*b*, and by manipulating the lever 78 of the stopper key 77, the flat plate member 79 is elastically horizontally moved and inserted into the recess 31*a* of the main body 30 and fixed thereto.

Next, when the lever 75*b* is released to horizontally move the connection rod 74 according to the type of the grinding stone 51, the shape of a workpiece, a work location, etc., the connection rod 74 is horizontally moved in the inclined slots 73*c* of the inner semicircular plate 72B, and accordingly the inner semicircular plate 72B is vertically moved, thereby adjusting a height thereof.

As described above, according to the present disclosure, the grinding disc may be conveniently coupled/decoupled with respect to the grinder main body in a one-touch method, and thus the grinding disc that is a consumable for grinding or cutting may be simply and rapidly replaced, thereby greatly improving workability.

Furthermore, costs are much reduced by simplifying the constituent parts. Since stable fixing of the grinding disc is possible by the coupler, occurrence of a safety accident due to loosening of the grinding disc rotating at high speed during work may be prevented, and generation of vibration may be clearly prevented.

Furthermore, since the variable safety cover is mounted on the grinder main body to appropriately adjust the height according to the type of a grinding stone or the shape of a workpiece, compared to a conventional fixed-type safety cover, a worker may be effectively protected from risk factors such as ground particles or damage of the grinding disc.

Accordingly, the present disclosure has effects of enabling simple and rapid coupling/decoupling of the grinding disc and preventing loosening or vibration.

While the present inventive concept has been particularly shown and described with reference to preferred embodiments using specific terminologies, the embodiments and terminologies should be considered in descriptive sense only and not for purposes of limitation. Therefore, it will be understood by those of ordinary skill in the art that various changes in form and details may be made therein without departing from the spirit and scope of the present inventive concept as defined by the following claims.

[List of reference numerals]

| | |
|---|---|
| 10: grinder main body | 11: rotary shaft |
| 11a: screw hole | 12: fixing bolt |
| 20: power transfer member | 21: hook step |
| 22: recess | 23: flange |
| 24: hexagonal main body | 25a: step |
| 25b: through-hole | |
| 30: main body | 31: protruding surface |
| 32a: step | 32b: hexagonal hole |
| 33: coupling hole | 34: receiving recess |
| 35: washer | 36: snap ring |
| 40: ball plunger | |
| 50: grinding disc | 51: grinding stone |
| 52: coupling portion | 53: coupling piece |
| 54: insertion recess | 55: protrusion |
| 56: stopper | |
| 70: safety cover | 71a: fixing ring |
| 71b: bolt | 72A: outer semicircular plate |
| 72B: inner semicircular plate | 73a: bent piece |
| 73c: inclined slot | 74: connection rod |
| 75a: nut | 75b: lever |
| 76a: leaf spring | 76b: rubber plate |
| 77: stopper key | 78: lever |
| 79: flat plate member | |
| 80: rotary plate | 81: circular protrusion |
| 82: antivibration pad | 83: pad receiving recess |
| 84: circular recess | 85: guide protrusion |
| P: coupler | |

What is claimed is:

1. A hand grinder comprising:

a grinder main body;

a coupler comprising:

a power transfer member coupled to a rotary shaft of a grinder main body; and a main body provided between the grinder main body and power transfer member;

a grinding disc comprising:

a grinding stone having a hollow disc plate; and a coupling portion provided at a central portion of the grinding stone and detachably coupled to the coupler;

a plurality of hook steps that are radially arranged along an outer circumference of an upper end portion of the power transfer member;

a plurality of coupling pieces that are radially arranged on an inner circumference of a central portion of the coupling portion;

a stopper that protrudes upward from an upper surface of the coupling pieces, wherein the stopper contacts the hook steps during coupling of the grinding disc to prevent idling of the power transfer member coupled to the coupling portion and simultaneously, during driving of the grinder main body, to transfer rotation power applied through the rotary shaft to the grinding disc; and wherein, when the grinding disc is assembled such that the hook steps pass between the coupling pieces and the main body is rotated, a lower surface of the hook steps is placed on an upper surface of the coupling pieces and the grinding disc is fixed to the coupler.

2. The hand grinder of claim 1, wherein the coupling pieces are rounded at a coupling start point thereof to facilitate the coupling with the hook steps and the coupling pieces are rounded at a coupling end point thereof to have the hook steps closely contact with the stopper, and a plane is formed between a pair of rounded portions.

3. The hand grinder of claim 2, further comprising:

a rotary plate that is rotatably coupled to an upper surface of the main body, and the power transfer member is coupled to the rotary plate and the main body by penetrating therethrough, and a plurality of circular protrusions that are formed on an upper surface of the rotary plate in a circumferential direction, and a plurality of insertion recesses corresponding to the circular protrusions are formed on a lower surface of the coupling portion in a circumferential direction.

4. The hand grinder of claim 3, further comprising a protruding surface formed on an outer circumferential surface of the main body, a flat plate portion having a step to couple the rotary plate is formed on the upper surface of the main body, and a hexagonal hole to which the power transfer member is coupled is formed at a center of the flat plate portion.

5. The hand grinder of claim 4, wherein coupling holes to which a ball plunger is assembled are formed on the flat plate portion, a plurality of circular recesses in which balls of the ball plunger are inserted are formed in a lower surface of the rotary plate, and the balls of the ball plunger are inserted into the circular recesses to restrict rotation of the rotary plate.

6. The hand grinder of claim 5, wherein the circular recesses comprise five circular recesses radially arranged along a left outer circumference of the rotary plate and five circular recesses radially arranged along a right outer circumference of the rotary plate, and the ball plunger comprise a pair of ball plungers inserted in two circular recesses of the five circular recesses arranged along the left outer circumference of the rotary plate, and a pair of ball plungers inserted in two circular recesses of the five circular recesses arranged along the right outer circumference of the rotary plate.

7. The hand grinder of claim 6, wherein the pair of the ball plungers are inserted one by one in every other circular recesses among the five circular recesses arranged along the left outer circumference of the rotary plate, and the other pair of the ball plungers are respectively inserted one by one in every other circular recesses among the five circular recesses arranged along the right outer circumference of the rotary plate.

8. The hand grinder of claim 7, wherein the rotary plate is manufactured of synthetic resin, the circular protrusions is manufactured of metal, and the rotary plate and the circular protrusions are integrally formed by insert injection.

9. The hand grinder of claim 8, wherein a depth of even-numbered circular recesses of the five circular recesses arranged along the left outer circumference of the rotary plate is deeper than a depth of odd-numbered circular recesses of the five circular recesses, and a depth of even-numbered circular recesses of the five circular recesses arranged along the right outer circumference of the rotary plate is deeper than a depth of odd-numbered circular recesses of the five circular recesses.

10. The hand grinder of claim 1, wherein a recess is formed in a lower surface of the hook steps, and a protruding inserted in the recess is formed on each of the coupling pieces, and when the grinding disc is assembled such that the hook steps passes between the coupling pieces and the main body is rotated, the protrusion is inserted in the recess and thus the grinding disc is fixed to the coupler.

11. A method of coupling a grinding disc of a hand grinder, the method comprising:

preparing a grinding disc comprising a grinding stone having a hollow disc shape and a coupling portion having a hollow disc shape coupled to a central portion of the grinding stone, wherein a plurality of coupling pieces protrude inwardly toward the coupling portion (first operation);

preparing a coupler inserted into a hollow hole of the coupling portion and coupled thereto, having a power transfer member that is a center axis, formed at a central portion thereof, and having hook steps having a shape capable of passing between a pair of neighboring coupling pieces, formed at an end portion of the power transfer member (second operation);

placing the grinding disc on the coupler such that the hook steps pass between the coupling pieces (third operation);

coupling the grinding disc to the coupler by rotating the grinding disc such that a rear surface of each of the hook steps contacts an upper surface of each of the coupling pieces (fourth operation); and wherein a stopper protrudes upward from an upper surface of the coupling pieces, the stopper contacts the hook steps during coupling of the grinding disc to prevent idling of the power transfer member coupled to the coupling portion and simultaneously, during driving of a grinder main body, to transfer rotation power applied through a rotary shaft to the grinding disc.

12. The method of claim 11, wherein the coupling pieces are rounded at a coupling start point thereof to facilitate the coupling with the hook steps and the coupling pieces are rounded at a coupling end point thereof to have the hook steps closely contact with a stopper, and a plane is formed between a pair of rounded portions.

13. The method of claim 12, wherein a rotary plate is rotatably coupled to an upper surface of the main body, and the power transfer member is coupled to the rotary plate and the main body by penetrating therethrough, and a plurality of circular protrusions are formed on an upper surface of the rotary plate in a circumferential direction, and a plurality of insertion recesses corresponding to the circular protrusions are formed on a lower surface of the coupling portion in a circumferential direction.

14. The method of claim 13, wherein a protruding surface is formed on an outer circumferential surface of the main body, a flat plate portion having a step to couple the rotary plate is formed on the upper surface of the main body, and a hexagonal hole to which the power transfer member is coupled is formed at a center of the flat plate portion.

15. The method of claim 14, wherein coupling holes to which a ball plunger is assembled are formed on the flat plate portion, a plurality of circular recesses in which balls of the ball plunger are inserted are formed in a lower surface of the rotary plate, and the balls of the ball plunger are inserted into the circular recesses to restrict rotation of the rotary plate.

16. The method of claim 13, wherein the circular recesses comprises five circular recesses radially arranged along a left outer circumference of the rotary plate and five circular recesses radially arranged along a right outer circumference of the rotary plate, and a ball plunger comprises a pair of ball plungers inserted in two circular recesses of the five circular recesses arranged along the left outer circumference of the rotary plate, and a pair of ball plungers inserted in two circular recesses of the five circular recesses arranged along the right outer circumference of the rotary plate.

17. The method of claim 16, wherein the pair of the ball plungers are inserted one by one in every other circular recesses among the five circular recesses arranged along the left outer circumference of the rotary plate, and the other pair of the ball plungers are respectively inserted one by one in every other circular recesses among the five circular recesses arranged along the right outer circumference of the rotary plate.

18. The method of claim 17, wherein the rotary plate is manufactured of synthetic resin, the circular protrusions is manufactured of metal, and the rotary plate and the circular protrusions are integrally formed by insert injection.

19. The method of claim 18, wherein a depth of even-numbered circular recesses of the five circular recesses arranged along the left outer circumference of the rotary plate is deeper than a depth of odd-numbered circular recesses of the five circular recesses, and a depth of even-numbered circular recesses of the five circular recesses arranged along the right outer circumference of the rotary plate is deeper than a depth of odd-numbered circular recesses of the five circular recesses.

20. The method of claim 11, wherein a recess is formed in a lower surface of the hook steps, and a protruding inserted in the recess is formed on each of the coupling pieces, and when the grinding disc is assembled such that the hook steps passes between the coupling pieces and the main body is rotated, the protrusion is inserted in the recess and thus the grinding disc is fixed to the coupler.

* * * * *